US011172748B2

(12) United States Patent
Arai et al.

(10) Patent No.: US 11,172,748 B2
(45) Date of Patent: Nov. 16, 2021

(54) BAR-SHAPED COSMETIC HOUSING CONTAINER

(71) Applicants: KOSE CORPORATION, Tokyo (JP); TAKEUCHI PACKAGE CO., LTD., Tokyo (JP)

(72) Inventors: Kei Arai, Tokyo (JP); Masashi Hirakawa, Tokyo (JP)

(73) Assignee: Kose Corporation, Tokyo (JP)

( * ) Notice: Subject to any disclaimer, the term of this patent is extended or adjusted under 35 U.S.C. 154(b) by 0 days.

(21) Appl. No.: 16/961,464

(22) PCT Filed: Jan. 17, 2019

(86) PCT No.: PCT/JP2019/001189
§ 371 (c)(1),
(2) Date: Jul. 10, 2020

(87) PCT Pub. No.: WO2019/142847
PCT Pub. Date: Jul. 25, 2019

(65) Prior Publication Data

US 2021/0085057 A1 Mar. 25, 2021

(30) Foreign Application Priority Data

Jan. 19, 2018 (JP) ..... JP2018-007491

(51) Int. Cl.
*A45D 40/06* (2006.01)

(52) U.S. Cl.
CPC ..... *A45D 40/065* (2013.01)

(58) Field of Classification Search
CPC ..... A45D 40/00; A45D 40/04; A45D 40/06; A45D 40/065; A45D 40/22; A45D 2040/0062
See application file for complete search history.

(56) References Cited

U.S. PATENT DOCUMENTS 3,335,853 A * 8/1967 Geisel ..... A45D 40/06 401/68
3,493,308 A * 2/1970 Sperry ..... A45D 40/06 401/59

(Continued)

FOREIGN PATENT DOCUMENTS

JP S60-173221 U 11/1985
JP H01-155917 U 10/1989

(Continued)

*Primary Examiner* — J C Jacyna
(74) *Attorney, Agent, or Firm* — Norris McLaughlin, P.A.

(57) ABSTRACT

A bar-shaped cosmetic housing container includes: a dish member that holds a bar-shaped cosmetic and has an engaging portion; an inner cylinder member that has a dish-member guide groove with which the engaging portion of the dish member is engaged and a body-member slit groove with which a rotation control portion provided in a body member is engaged; the body member has a guidance groove with which the engaging portion is engaged and has the rotation control portion that is engaged with the body portion slit groove on an inner peripheral surface thereof; a screw member in which a screw groove is formed on an inner peripheral surface, the engaging portion being engaged with the screw groove and the dish member being moved in an up/down direction; and a skirt member that is provided in a lower end portion of the body member.

5 Claims, 20 Drawing Sheets

(56) References Cited

U.S. PATENT DOCUMENTS

| | | | | | |
|---|---|---|---|---|---|
| 4,108,558 | A * | 8/1978 | Radice | A45D 40/06 | 401/78 |
| 4,380,402 | A * | 4/1983 | Andrews | A45D 40/06 | 401/74 |
| 4,973,178 | A * | 11/1990 | Kakuta | A45D 40/065 | 401/59 |
| 6,412,999 | B1 * | 7/2002 | Pierpont | A45D 40/12 | 401/68 |
| 7,422,387 | B2 * | 9/2008 | Kurihara | A45D 40/06 | 401/78 |
| 2008/0277300 | A1 * | 11/2008 | Kang | A45D 40/065 | 206/385 |
| 2014/0219704 | A1 * | 8/2014 | Huang | A45D 40/12 | 401/74 |
| 2016/0037890 | A1 * | 2/2016 | Chen | B05B 11/0032 | 222/154 |
| 2016/0249729 | A1 * | 9/2016 | Hermouet | A45D 40/22 | 401/68 |
| 2019/0082809 | A1 * | 3/2019 | Benigni | A45D 40/06 | |
| 2019/0357657 | A1 * | 11/2019 | Presche | A45D 40/06 | |

FOREIGN PATENT DOCUMENTS

| | | | |
|---|---|---|---|
| JP | 2002-101950 | A | 4/2002 |
| JP | 3892924 | B2 | 3/2007 |
| JP | 2007-289244 | A | 11/2007 |
| JP | 2020-156829 | * | 10/2020 |

* cited by examiner

BAR-SHAPED COSMETIC HOUSING CONTAINER

BACKGROUND OF THE INVENTION

1. Field of the Invention

The present invention relates to a stick-shaped cosmetic housing container that holds a bar-shaped cosmetic such as lipstick.

2. Description of the Related Art

Conventionally, among bar-shaped cosmetic housing containers, as a housing container in which an inner cylinder member rises, a dish member subsequently rises, and a bar-shaped cosmetic is exposed, "a bar-shaped cosmetic container in which a bar-shaped cosmetic is housed so as to freely appear and disappear, the bar-shaped cosmetic container characterized by including: a receptacle that holds a lower portion of the bar-shaped cosmetic; a sleeve that includes therein the receptacle such that the receptacle freely slides in an up/down direction and houses at least an upper end portion of the bar-shaped cosmetic; an inner cylinder that includes therein the sleeve such that the sleeve freely slides in the up/down direction and has an opening portion on an upper end; an outer cylinder that provided outside the inner cylinder such that the outer cylinder is suppressed from sliding in an axial direction and freely rotates in a circumferential direction; a cap that is mounted on the opening portion end of the inner cylinder so as to freely open and close; and an up/down mechanism in which, as a result of the inner cylinder or the outer cylinder being rotated in relation to the outer cylinder or the inner cylinder, the sleeve is drawn out from the opening portion before the bar-shaped cosmetic, the cap is opened by a tip end thereof, and the sleeve and the bar-shaped cosmetic are ultimately drawn out to a position at which the sleeve and the bar-shaped cosmetic protrudes from the opening portion of the inner cylinder, in which the up/down mechanism is configured by: a first protrusion that is provided in a protruding manner on a cylinder wall outer surface of the receptacle; a first guide groove that is provided in a penetrating manner along a cylinder wall axial direction of the sleeve and a second protrusion that is provided in a protruding manner on a cylinder wall outer surface; a second guide groove that is provided in a penetrating manner along a cylinder wall axial direction of the inner cylinder so as to overlap the above-described first guide groove on the sleeve side, and a cam groove that is provided in a penetrating manner along the cylinder wall axial direction of the inner cylinder such that the second protrusion is engaged therewith; and a screw groove that is provided in an engraved manner on a cylinder wall inner surface of the outer cylinder such that a tip end of the first protrusion on the receptacle side that has simultaneously passed through the first guide groove on the sleeve side and the second guide groove on the inner cylinder side is engaged therewith, in which the cam groove includes a guiding portion that is provided in a penetrating manner along the cylinder wall axial direction of the inner cylinder and a cam portion that is continuous with an upper end side of the guiding portion so as to bend upward towards one side in the circumferential direction of the cylinder wall, the first guide groove includes an L portion that is provided in a continuous manner in a lower end portion by being cut in the circumferential direction, and when the bar-shaped cosmetic is housed, the first protrusion of the receptacle is engaged in the L portion" and the like are known (Patent Literature 1).

However, in the above-described publicly known invention described in Patent Literature 1, because a notch is provided so as to oppose a lower portion of the receptacle for assembly, rigidity of the receptacle decreases. As a result of the receptacle being easily bent, there is a disadvantage in that the first protrusion of the receptacle becomes detached from the screw groove and the bar-shaped cosmetic is unable to be drawn out. Furthermore, there is a disadvantage in that the bar-shaped cosmetic becomes affected by the bending of the receptacle and breaks inside the receptacle.

[Patent Literature 1] Japanese Patent Publication No. 3892924

SUMMARY OF THE INVENTION

In light of conventional disadvantages such as those described above, an object of the present invention is to provide a bar-shaped cosmetic housing container that can be easily assembled and in which a dish member does not easily bend.

To achieve the above-described object, a bar-shaped cosmetic housing container according to a first aspect of the present invention is characterized by including: a dish member that holds a bar-shaped cosmetic and has an engaging portion in a lower portion; an inner cylinder member that has a dish-member guide groove with which the engaging portion of the dish member is engaged and a body-member slit groove with which a rotation control portion that is provided in a body member is engaged; the body member that has a guidance groove with which the engaging portion is engaged and has the rotation control portion that is engaged with the body portion slit groove on an inner peripheral surface thereof; a screw member in which a screw groove is formed on an inner peripheral surface, the engaging portion being engaged with the screw groove and the dish member being moved in an up/down direction; and a skirt member that is provided in a lower end portion of the body member. The dish-member guide groove has a crank-shaped bent portion in a lower portion thereof and is formed to reach a lower end portion of the inner cylinder member. The body-member slit groove has a sloped portion that slopes in a circumferential direction in a lower portion thereof. When the screw member is rotated and the dish member is raised, the engaging portion of the dish member comes into contact with the bent portion, and the inner cylinder member rises synchronously with the dish member. In addition, when the rotation control portion moves to the sloped portion, the inner cylinder member is rotated in the circumferential direction by the sloped portion. The guidance groove and the dish-member guide groove are in a substantially overlapping state. As a result, only the dish member rises.

A bar-shaped cosmetic housing container according to a second aspect is characterized in that a cap body that freely opens and closes is provided in an upper end portion of the body member. The cap body is urged in a direction in which a cap closes by an urging means.

A bar-shaped cosmetic housing container according to a third aspect is characterized in that the urging means is configured by a pair of locking pieces that are formed in an upper portion of the body member and the cap body, and an annular elastic body that is locked by the pair of locking pieces.

A bar-shaped cosmetic housing container according to a fourth aspect is characterized in that a slip preventing mechanism is provided on a surface of the screw member.

A bar-shaped cosmetic housing container according to a fifth aspect is characterized in that a locking portion that further extends in the circumferential direction from a lower end portion of the sloped portion is formed in the body-member slit groove. When the dish member is raised, the rotation control portion enters the locking portion.

Effects of the Invention

As is clear from the description above, the present invention achieves the effects listed below:

(1) In the invention according to the first aspect, the dish-member guide groove of which the lower end portion thereof reaches the lower end portion of the inner cylinder member and has the crank-shaped bent portion is formed in the inner cylinder member. Therefore, the engaging portion of the dish member can be easily engaged (inserted) with the dish-member guide groove.

Consequently, assembly can be facilitated.

(2) The engaging portion of the dish member can be inserted from the lower end portion of the dish-member guide groove. Therefore, a notch or the like is not required to be formed in the dish member. Rigidity of the dish member can be ensured. The dish member can be made difficult to bend.

Consequently, the bar-shaped cosmetic can be held without being affected by bending of the dish member.

(3) The inventions according to the second aspect and the third aspect also achieve effects similar to (1) and (2), described above.

(4) The invention according to the fourth aspect also achieves effects similar to (1) and (2), described above. In addition, the screw member can be easily rotated.

(5) The invention according to the fifth aspect also achieves effects similar to (1) and (2), described above. In addition, because the locking portion that further extends in the circumferential direction from the lower end portion of the sloped portion of the body-member slit groove is provided, even should load be applied downward from an upper portion after the dish member is moved near an upper dead point, the rotation control portion comes into contact with the locking portion. The rotation control portion moving to the sloped portion, the inner cylinder member rotating, an operation pin getting caught, and operation becoming poor can be prevented.

BRIEF DESCRIPTION OF THE DRAWING

FIG. 1 is a vertical cross-sectional view of a bar-shaped cosmetic housing container according to a first embodiment;

FIG. 2 is a front view of a dish member;

FIG. 3 is a front view of an inner cylinder member;

FIG. 4 is a back view of the inner cylinder member;

FIG. 5 is a front view of a body member;

FIG. 6 is a vertical cross-sectional view of the body member;

FIG. 7 is an exploded perspective view of the dish member, the inner cylinder member, and the body member;

FIG. 8 is an explanatory diagram of an urging means;

FIG. 9 is an explanatory diagram of a state in which the inner cylinder member is raised to a top dead point;

FIG. 10 is an explanatory diagram of a state in which the dish member is raised to a top dead point;

FIG. 11 is a vertical cross-sectional view of a bar-shaped cosmetic housing container according to a second embodiment;

FIG. 12 is an explanatory diagram of an urging means;

FIG. 13 is a vertical cross-sectional view of a bar-shaped cosmetic housing container according to a third embodiment;

FIG. 14 is a front view of the bar-shaped cosmetic housing container;

FIG. 15 is a vertical cross-sectional view of a storage container according to a fourth embodiment;

FIG. 16 is a front view of an inner cylinder member;

FIG. 17 is a back view of the inner cylinder member;

FIG. 18 is an exploded perspective view of a dish member, the inner cylinder member, and a body member;

FIG. 19 is an explanatory diagram of a state in which the inner cylinder member is raised to a top dead point; and FIG. 20 is an explanatory diagram of a state in which the dish member is raised to a top dead point.

EXPLANATION OF REFERENCE NUMBERS

Figure 1:
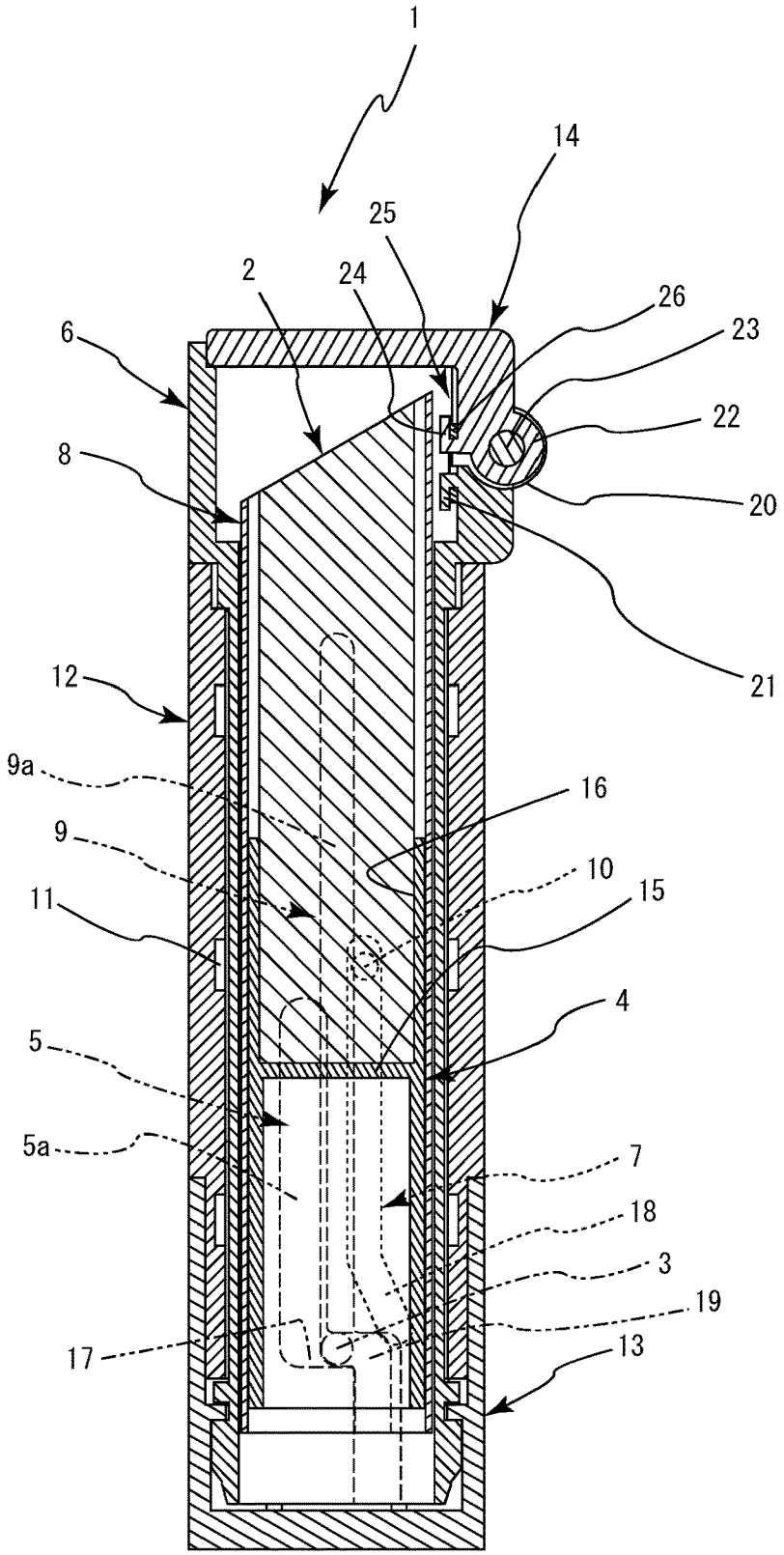
FIG. 1 to FIG. 10 are explanatory diagrams according to a first embodiment of the present invention.

1, 1A, 1B, 1C: bar-shaped cosmetic housing container
2: bar-shaped cosmetic
3: engaging portion
4: dish member
5, 5A: dish-member guide groove
6: body member
7, 7A: body-member slit groove
8, 8A: inner cylinder member
9: guidance groove
10: rotation control portion
11: screw groove
12, 12A: screw member
13, 13A: skirt member
14: cap body
15: partition wall
16: bar-shaped cosmetic holding portion
17, 17A: bent portion
18: sloped portion
19: crank portion
20: cap-body attaching portion
21: one locking piece
22: attaching piece
23: shaft
24: another locking piece
25, 25A: urging means
26: elastic body
27: arm insertion hole
28: torsion spring
29: slip preventing mechanism
30: locking portion
31: dish-member sloped portion

DETAILED DESCRIPTION OF THE PREFERRED EMBODIMENTS

The present invention will hereinafter be described in detail based on embodiments for carrying out the present invention shown in the drawings.

According to a first embodiment for carrying out the present invention shown in FIG. 1 to FIG. 10, reference number 1 represents a bar-shaped cosmetic housing container (referred to, hereafter, as a "housing container") of the present invention that houses a bar-shaped cosmetic 2 such as lipstick. For example, as shown in FIG. 1, the housing container 1 is configured by: a dish member 4 that holds the bar-shaped cosmetic 2 and has an engaging portion 3 (such as an engaging pin) in a lower portion; an inner cylinder member 8 that has a dish-member guide groove 5 with which the engaging portion 3 of the dish member 4 is engaged (inserted) and a body-member slit groove 7 with which a rotation control portion 10 (such as a rotation control pin) of a body member 6 is engaged (inserted); the body member 6 that has a guidance groove 9 with which the engaging portion 3 of the dish member 4 is engaged (inserted) and has the rotation control portion 10 that is engaged (inserted) with the body portion slit groove 7 on an inner peripheral surface thereof; a screw member 12 in which a screw groove 11 is formed on an inner peripheral surface, the engaging portion 3 of the dish member 4 being inserted into the screw groove 11 and the dish member 4 being moved in an up/down direction; a skirt member 13 that is provided in a lower end portion of the body member 6; and a cap body 14 that is provided in an upper end portion of the body member 6.

Figure 2:
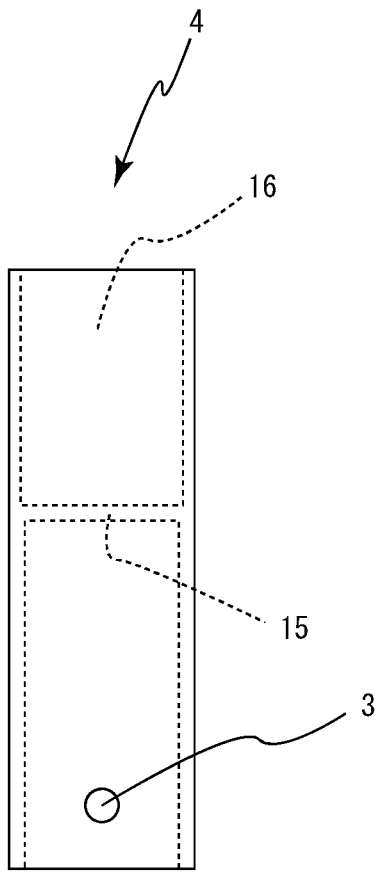

As shown in FIG. 2, according to the present embodiment, the dish member 4 is composed of resin and formed into a circular cylindrical shape. A substantially horizontal partition wall 15 is provided in a portion inside the dish member 4 that is towards an upper end portion. An upper portion space of the partition wall 15 serves as a bar-shaped cosmetic holding portion 16 that holds the bar-shaped cosmetic 2.

The engaging portion 3 is provided near a lower end portion of an outer peripheral wall of the dish member 4. According to the present embodiment, the engaging portion 3 is a substantially circular columnar protrusion.

Figure 3:
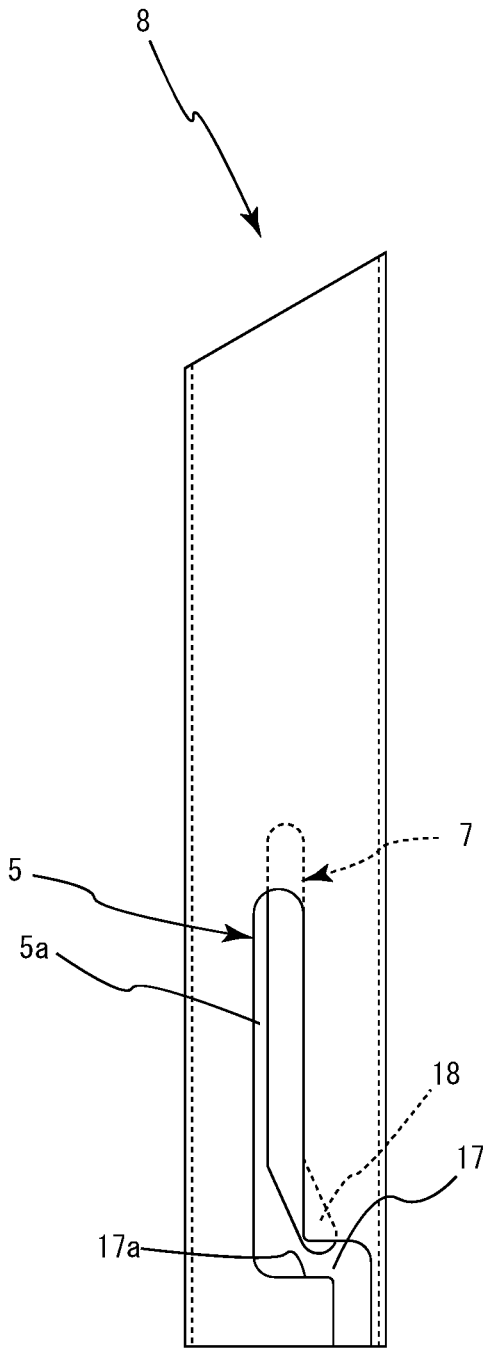
Figure 4:
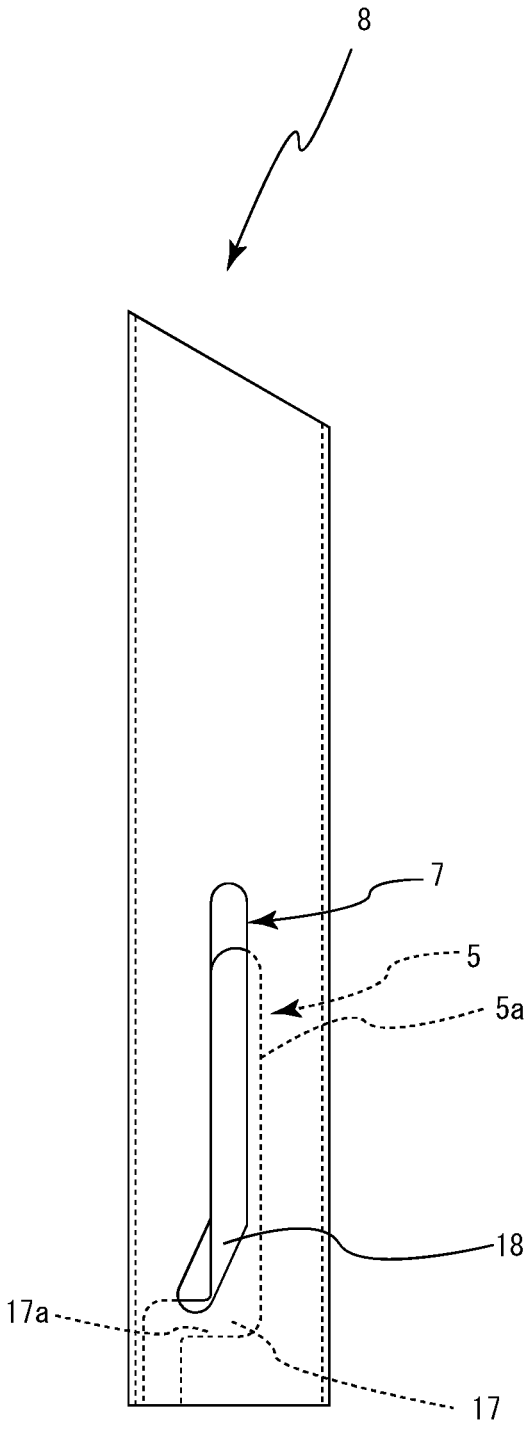

As shown in FIG. 3 and FIG. 4, according to the present embodiment, the inner cylinder member 8 is composed of metal and is a pipe-shaped member that covers an outer peripheral portion of the dish member 4. The inner cylinder member 8 is a substantially circular cylindrical member of which an upper portion is obliquely cut. The dish-member guide groove 5 and the body-member slit groove 7 are formed on a side surface of the inner cylinder member 8.

In the dish-member guide groove 5, an upper end portion of a vertical portion 5*a* thereof is positioned in a substantially intermediate portion of the inner cylinder member 8 in the up/down direction. A crank-shaped bent portion 17 that has a horizontal portion 17*a* is formed near a lower end portion of the inner cylinder member 8. A lower end portion of the dish-member guide groove 5 is formed so as to reach the lower end portion of the inner cylinder member 8.

As a result of the dish-member guide groove 5 being formed in this manner, when the engaging portion 3 of the dish member 4 engages with the dish-member guide groove 5, the engaging portion can engage from the lower end portion of the dish-member guide groove 5 (a slit in the inner cylinder member 8). Assembly can be easily performed without the dish member 4 and the inner cylinder member 8 being required to be bent. In addition, a notch or the like is not required to be provided in the dish member 4. Rigidity of the dish member 4 can be ensured.

Furthermore, in the dish-member guide groove 5, the lower end portion thereof reaches the lower end portion (lower end surface) of the inner cylinder member 8. A portion of the outer periphery of the inner cylinder member 8 is cut. Therefore, when the inner cylindrical member 8 is inserted into the body member 6, the lower portion of the inner cylinder member 8 bends and decreases in diameter, and the rotation control portion 10 can be inserted into the body-member slit groove 7.

For example, the dish-member guide groove 5 includes a crank-shaped bent portion 17. The bent portion 17 is formed such that the engaging portion 3 is positioned in the horizontal portion 17*a* of the bent portion 17 at normal times (when the bar-shaped cosmetic 2 and the dish member 4 are positioned in lower limit positions).

In the description according to the present embodiment, the body-member slit groove 7 is provided in a portion that opposes the dish-member guide groove 5. An upper end portion is positioned further above the upper end portion of the dish-member guide groove 5 in a substantially intermediate portion of the inner cylinder member 8 in the up/down direction. The body-member slit groove 7 extends substantially vertically downward. A sloped portion 18 that slopes in a circumferential direction is formed in a lower portion of the body-member slit groove 7. A lower end portion of the sloped portion 18 is formed so as to be positioned near the horizontal portion 17*a* of the bent portion 17.

In the description according to the present embodiment, the rotation control portion 10 is inserted in the body-member slit groove 7. In a normal state, the rotation control portion 10 is positioned near a substantially upper end portion of the body-member slit groove 7.

Figure 5:
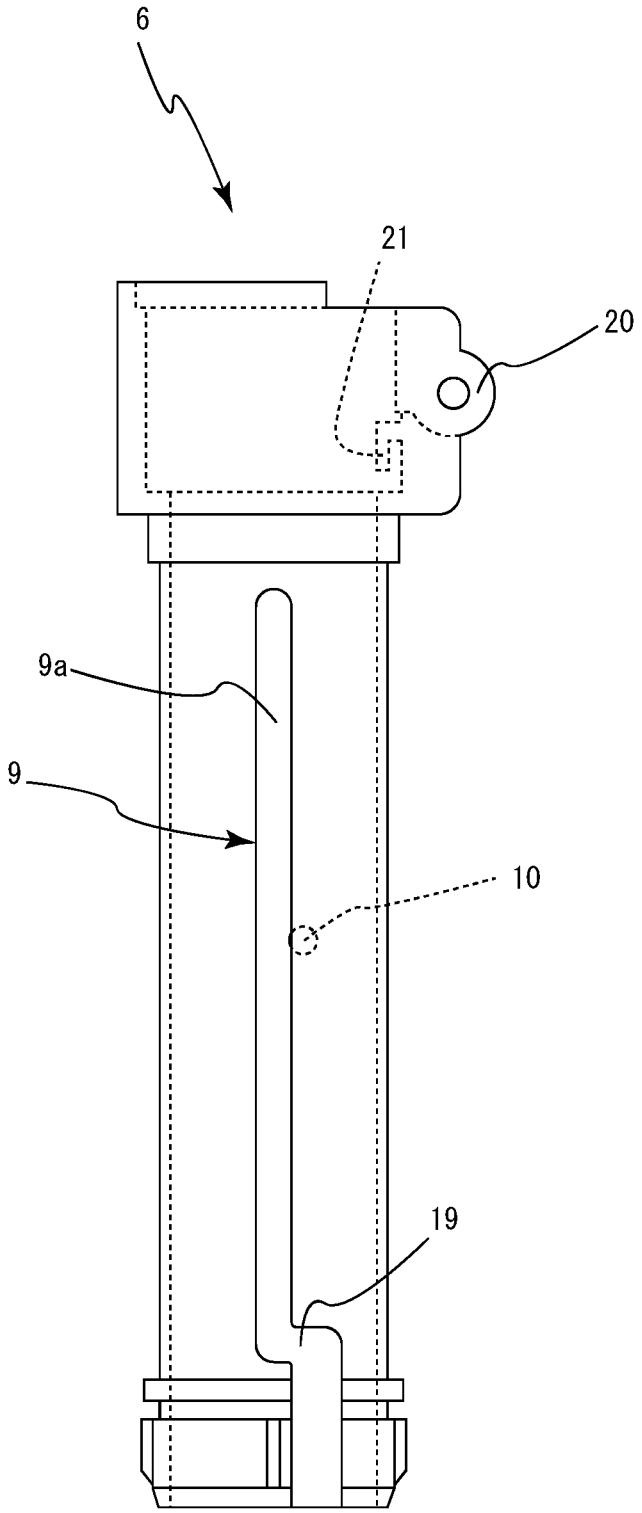
Figure 6:
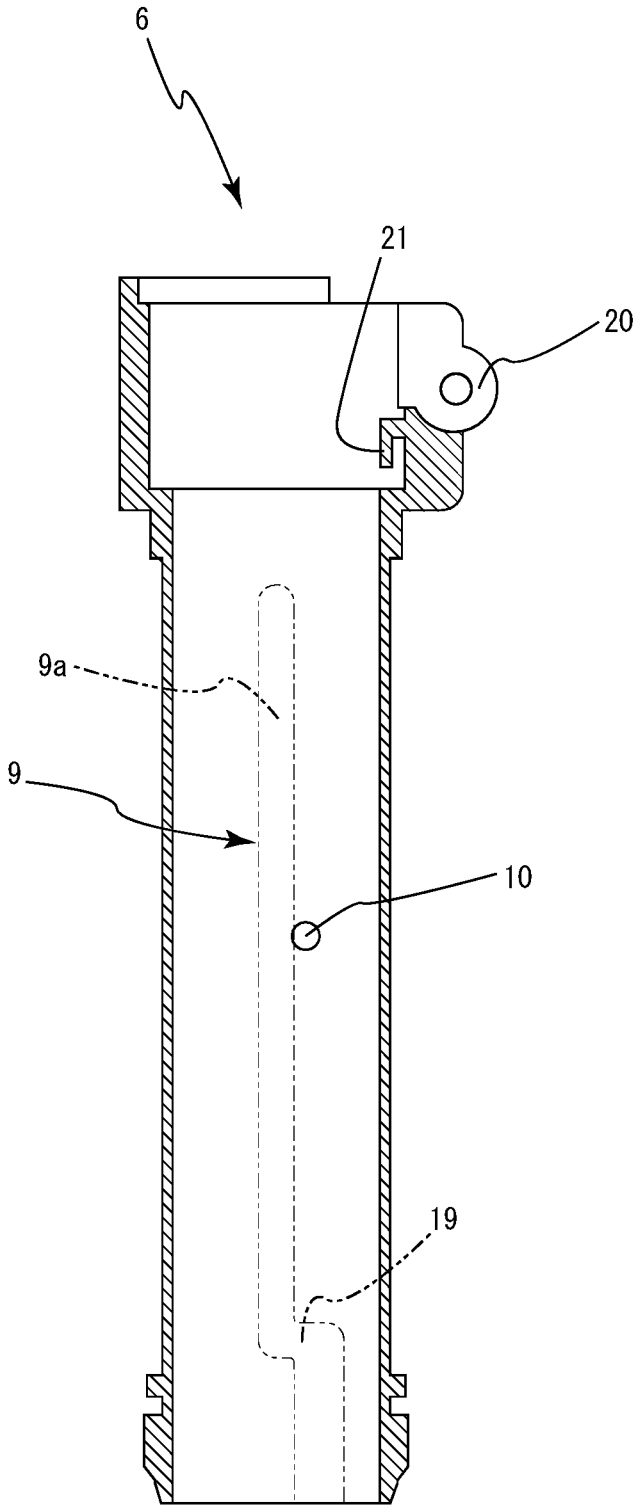
Figure 7:
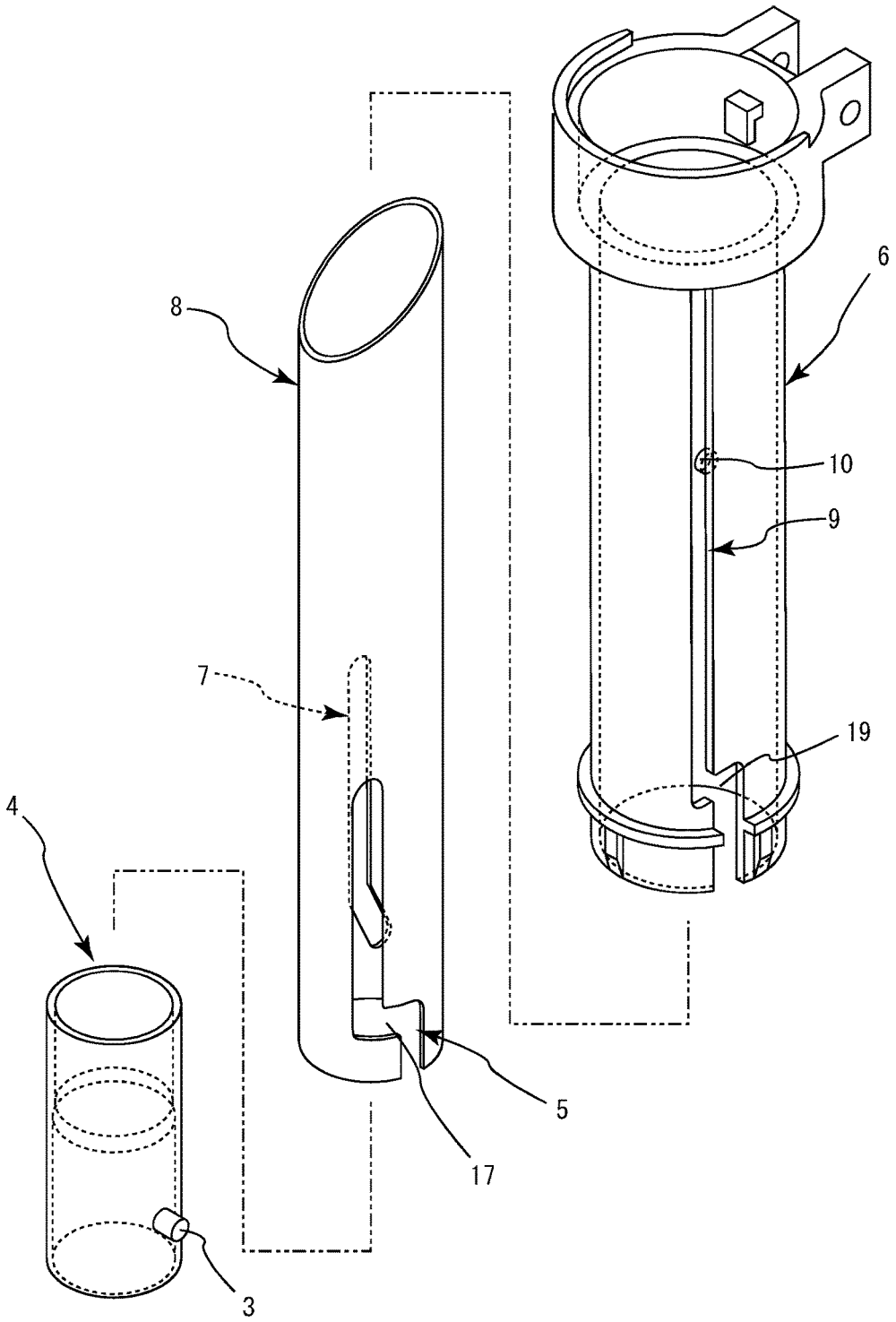

As shown in FIG. 5 and FIG. 6, according to the present embodiment, the body member 6 is composed of resin and is a member that covers the outer periphery of the inner cylinder member 8.

For example, as shown in FIG. 5, the body member 6 is formed into a substantially circular cylindrical shape in which an upper portion has a slightly large diameter. The guidance groove 9 that reaches a lower end portion of the body member 6 is formed on an outer peripheral portion of the body member 6. According to the present embodiment, the guidance groove 9 includes, in a lower portion thereof, a crank portion 19 that is bent into a crank-shape. A lower end portion of the guidance groove 9 (the crank portion 19) reaches a lower end surface of the body member 6. The engaging portion 3 of the dish member 4 can be inserted from this slit.

A lower end surface of the guidance groove 9 reaches the lower end portion of the body member 6. In addition, the lower end portion of the dish-member guide groove 5 of the inner cylinder member 8, described above, reaches the lower end portion of the inner cylinder member 8. Therefore, as a result of the body member 6 bending in a direction in which an inner diameter slightly widens, and the inner cylinder member 8 bending in a direction in which an outer diameter slightly narrows, the rotation control portion 10 can be easily inserted into the body-member slit groove 7.

A cap-body attaching portion 20 for attaching the cap body 14 is formed in a large diameter portion in the upper portion of the body member 6. According to the present embodiment, one locking piece 21 is provided near the cap-body attaching portion 20 in the upper portion of the body member 6.

In the description according to the present embodiment, the screw member 12 is formed into a stepped circular cylindrical shape in which an outer diameter in a lower portion is a small diameter. The screw groove 11 is formed on an inner peripheral surface of the screw member 12. The screw member 12 is a member that covers the outer periphery of the body member 6, excluding the large diameter portion.

The engaging portion 3 of the dish member 4 is inserted into the screw groove 11. As a result of the screw member 12 being rotated, the engaging portion 3 is pushed upward by the screw groove 11, and the dish member 4 is lifted upward.

In the description according to the present embodiment, the skirt member 13 is formed into a bottomed circular cylindrical shape. The skirt member 13 is attached in a state in which the lower end portion of the body member 6 is inserted inside the skirt member 13. Here, an outer periphery of the small diameter portion in the lower portion of the screw member 12 is covered by the upper portion of the skirt member 13.

As a result of the skirt member 13 being provided, even when the lower portion of the body member 6 is cut as a result of the guidance groove 9, bending of the body member 6 can be suppressed.

In the cap body 14, an attaching piece 22 that is composed of resin and attached to the cap-body attaching portion 20 is formed. The attaching piece 22 is pivotally supported to the cap-body attaching portion so as to be capable of rotating by a shaft 23. As a result of the cap body 14 rotating around the shaft 23, the opening in the upper portion of the body member 6 is opened and closed.

Figure 8:
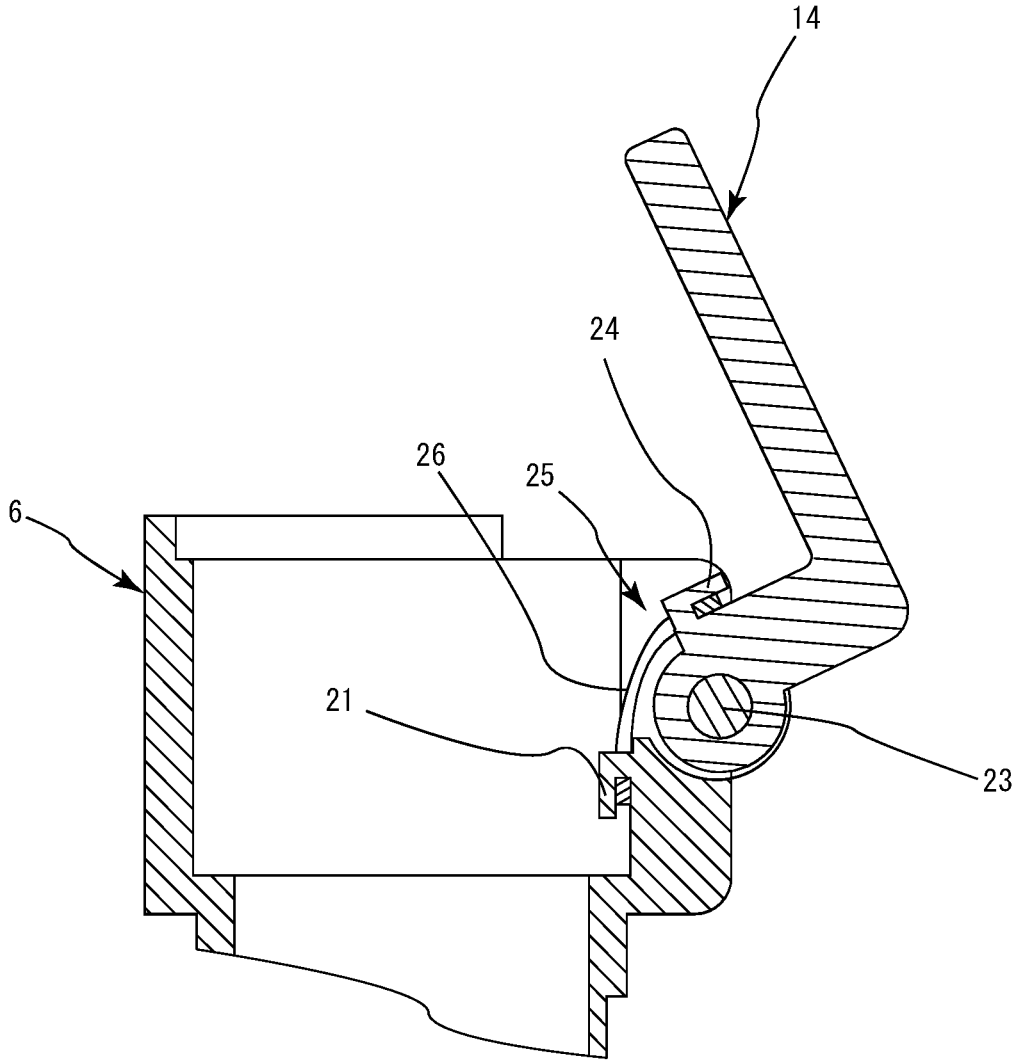

In addition, on a bottom surface near the attaching piece 22 of the cap body 14, another locking piece 24 that forms a pair with the one locking piece 21 is formed. According to the present embodiment, as shown in FIG. 8, an urging means 25 that urges the cap body 14 in a closing direction is configured by this pair of locking pieces 21 and 24, and an annular elastic body 26 that is locked by the pair of locking pieces 21 and 24. The elastic body 26 stretches when the cap body 14 is opened, and applies an urging force to the cap body 14 in the closing direction.

Movements of the dish member 4, the inner cylinder member 8, and the body member 6 when the housing container 1 of the invention of the present application is used will be described. When the engaging portion 3 is in a position of a lower dead point, the state is such that the engaging portion 3 of the dish member 4 is positioned in the horizontal portion 17*a* of the bent portion 17 of the dish-member guide groove 5 and the rotation control portion 10 is inserted into the body-member slit groove 7. Therefore, the state is such that the inner cylinder member 8 does not rotate in relation to the body member 6, and the engaging portion 3 of the dish member 4 does not move from the horizontal portion 17*a*.

Figure 9:
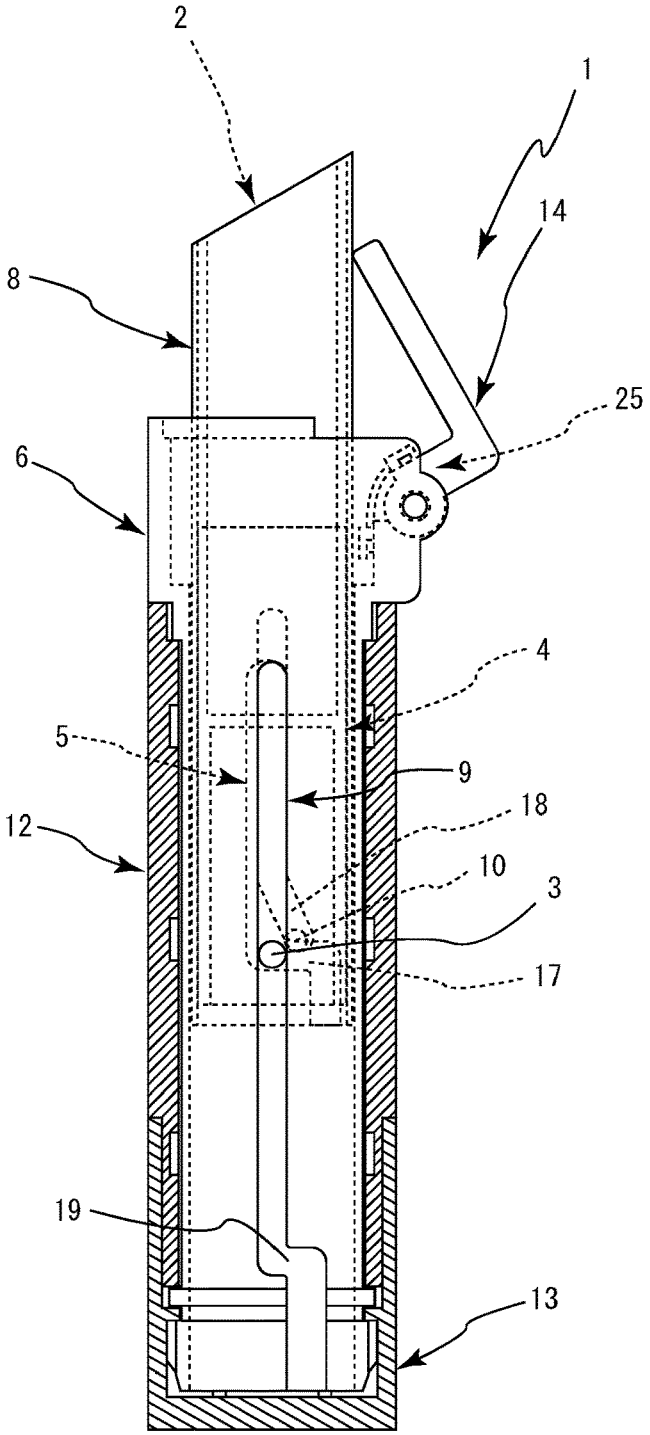

As shown in FIG. 9, as a result of the screw member 12 being rotated, the engaging portion 3 of the dish member 4 is lifted along the screw groove 11 and the dish member 4 is raised. At this time, the engaging portion 3 of the dish member 4 is inserted into the guidance groove 9 of the body member 6. Therefore, the dish member 4 moves upward without rotating.

In addition, in the inner cylinder member 8, the engaging portion 3 of the dish member 4 is in contact with the horizontal portion 17*a* of the bent portion 17. Therefore, the dish member 4 lifts the inner cylinder member 8, and the dish member 4 and the inner cylinder member 8 are synchronously raised. The inner cylinder member 8 is simply merely lifted by the engaging portion 3. In addition, the rotation control portion 10 of the body member 6 is inserted into the body-member slit groove 7. Therefore, the inner cylinder member 8 moves upward without rotating.

At this time, the inner cylinder member 8 lifts the cap body 14 and opens the upper end portion of the body member 6.

When the screw member 12 is continuously rotated and the rotation control portion 10 moves to the sloped portion 18 of the body-member slit groove 7, the rotation control portion 10 moves into the sloped portion 18 of the inner cylinder member 8. As a result, the inner cylinder member 8 slightly rotates and reaches an upper dead point.

Then, rising of the inner cylinder member 8 stops. In addition, a vertical portion 9*a* of the guidance groove 9 and the vertical portion 5*a* of the dish-member guide groove 5 substantially overlap. In accompaniment, the engaging portion 3 of the dish member 4 moves from the horizontal portion 17*a* of the bent portion 17 to a lower end portion (lower dead point) of the vertical portion 5*a* of the dish-member guide groove 5.

As described above, when the inner cylinder member 8 and the dish member 4 synchronously move upward, as a result of being pressed by the upper end portion of the inner cylinder member 8, the cap body 14 rotates against the urging force of the urging means 25 and enters an open state. In the state in which the inner cylinder member 8 is positioned at the upper dead point, the cap body 14 is in contact with the outer peripheral surface of the inner cylinder member 8 and maintains the open state without affecting the bar-shaped cosmetic 2.

Figure 10:
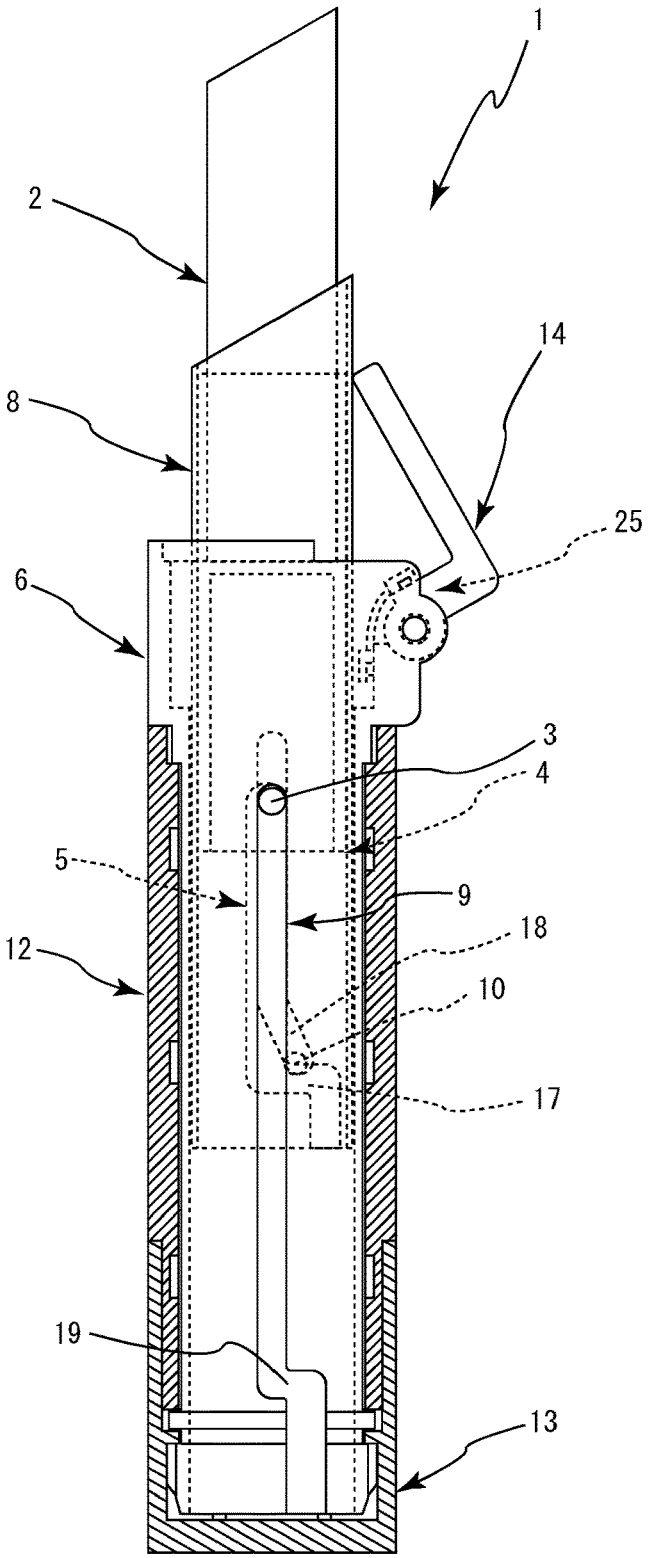

As a result of the screw member 12 being rotated in this state, the inner cylinder member 8 remains at this position, and only the dish member 4 rises. As shown in FIG. 10, the bar-shaped cosmetic 2 is exposed.

After use, when the bar-shaped cosmetic 2 is housed, the screw member 12 is rotated in a reverse direction and the dish member 4 is lowered. When the engaging portion 3 of the dish member 4 reaches the lower end portion (bent portion 17) of the vertical portion 5*a* of the dish-member guide groove 5, the inner cylinder member 8 is pressed downward by the engaging portion 3. The inner cylinder member 8 starts to move downward synchronously with the dish member 4. Then, the inner cylinder member 8 is rotated by the sloped portion 18 of the body-member slit groove 7. Subsequently, the inner cylinder member 8 moves to a lower limit position without rotating and returns to the normal state.

The cap body 14 is rotated by the urging means 25 when the inner cylinder member 8 moves into the body member 6, and seals the upper portion opening of the body portion 6.

OTHER EMBODIMENTS FOR CARRYING OUT THE INVENTION

Next, other embodiments for carrying out the present invention, shown in FIG. 11 to FIG. 20, will be described. Regarding the descriptions of the other embodiments for carrying out the present invention, constituent sections that are identical to those according to the above-described first embodiment for carrying out the present invention are given the same reference numbers. Redundant descriptions are omitted.

Figure 11:
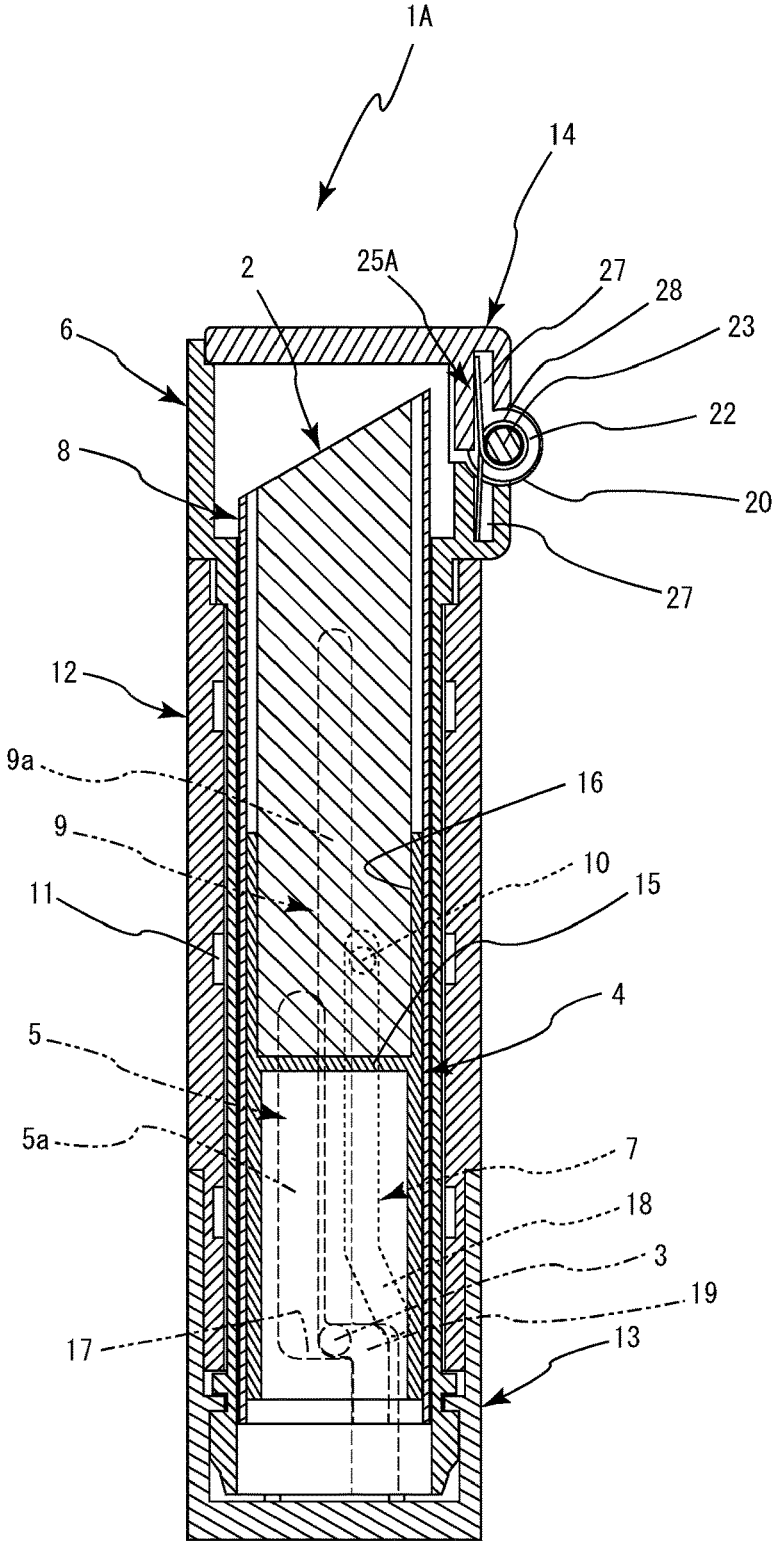
FIG. 11 and FIG. 12 are explanatory diagrams according to a second embodiment of the present invention.
Figure 12:
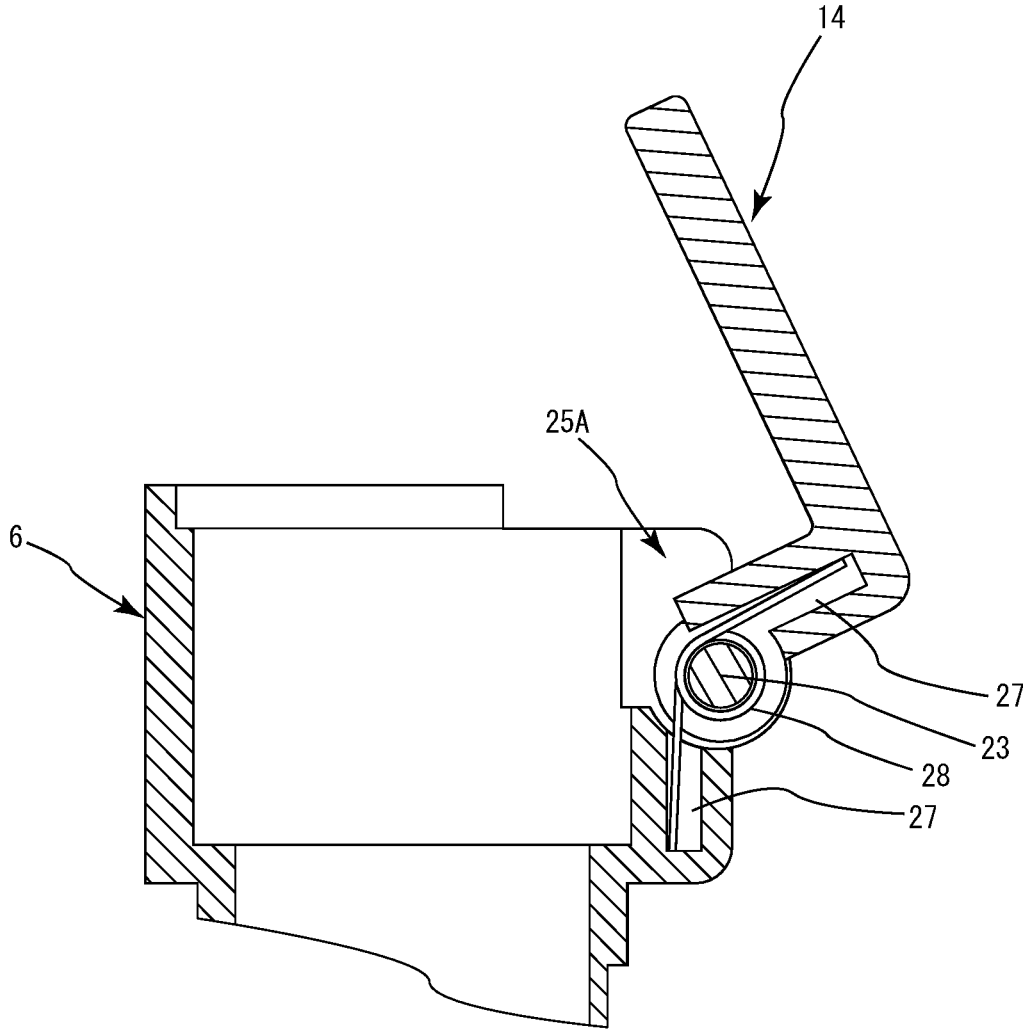

A second embodiment for carrying out the present invention, shown in FIG. 11 and FIG. 12, mainly differs from the first embodiment for carrying out the present invention in that an urging means 25A that urges the cap body 14 by a pair of arm insertion holes 27 and a torsion spring 28 is configured. The pair of arm insertion holes 27 are formed in the cap body 14 and the body member 6. Arms of the torsion spring 28 are respectively inserted into the pair of arm insertion holes 27. In addition, the torsion spring 28 is pivotally supported by the shaft 23. In a housing container 1A that uses such an urging means 25A as well, working effects similar to those of the above-described housing container according to the first embodiment for carrying out the present invention can be achieved.

Figure 13:
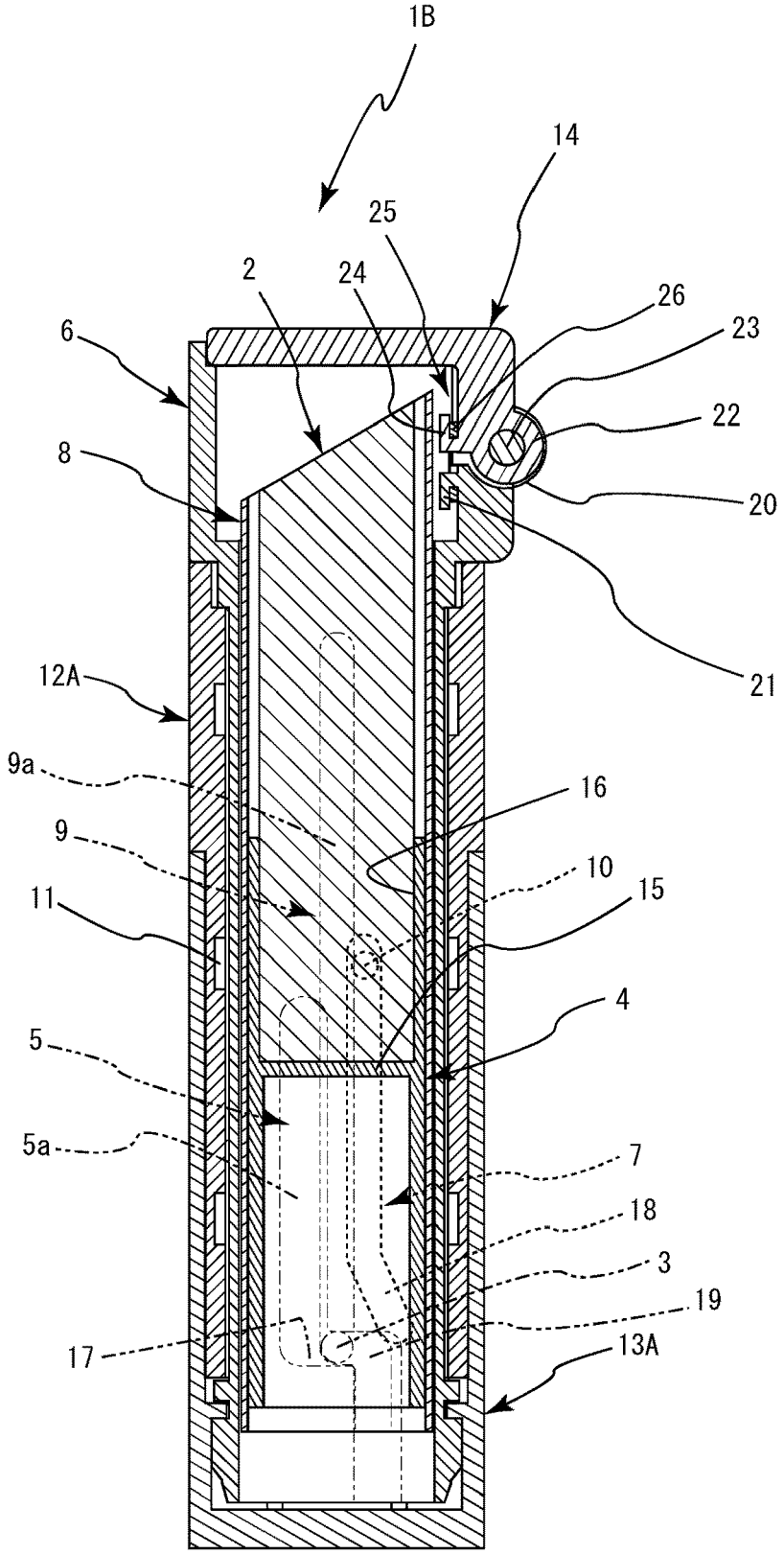
FIG. 13 and FIG. 14 are explanatory diagrams according to a third embodiment of the present invention.
Figure 14:
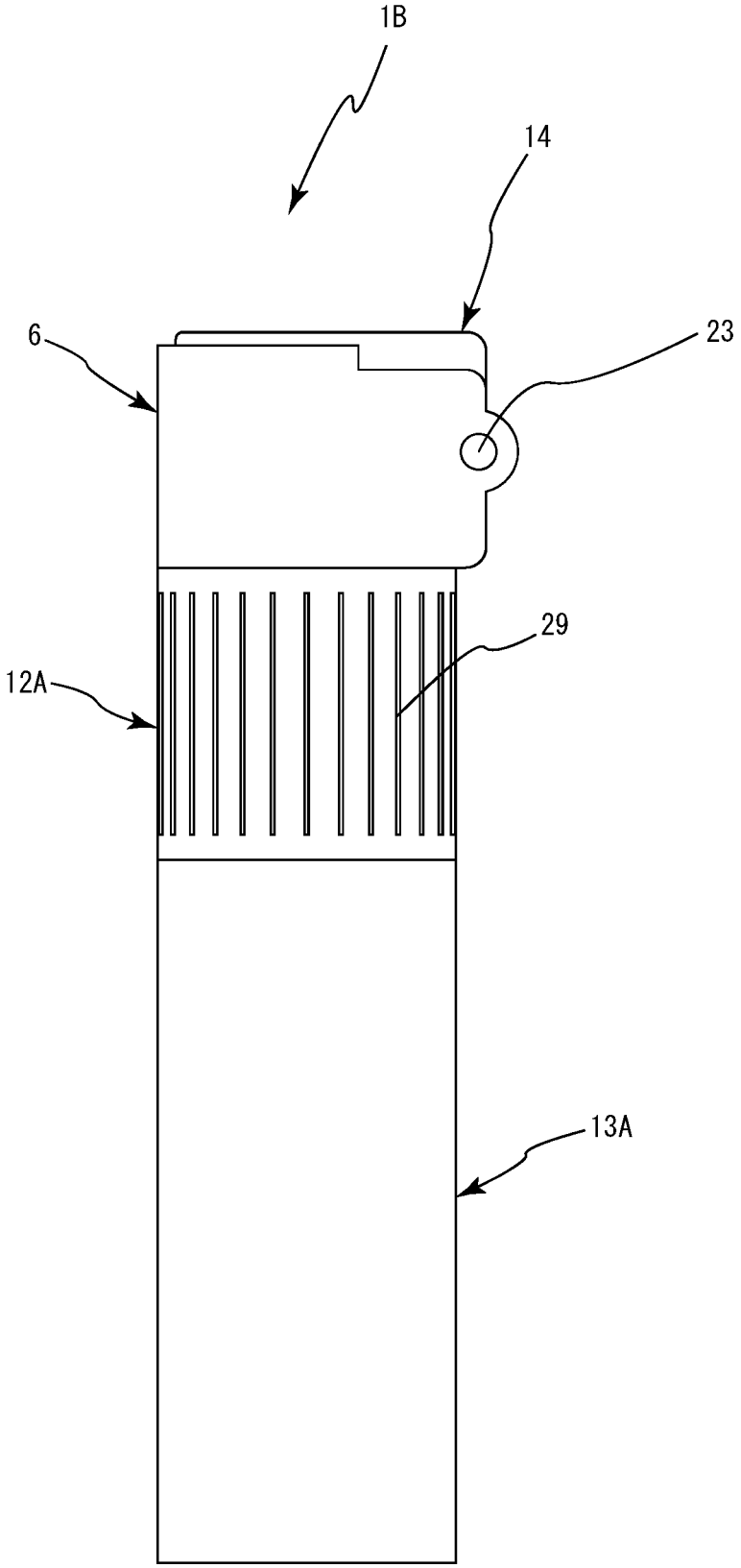

A third embodiment for carrying out the present invention, shown in FIG. 13 and FIG. 14, mainly differs from the first embodiment for carrying out the present invention in that a skirt member 13A and a screw member 12A are used. In the skirt member 13A, a length of a portion that is exposed outside is increased. In the screw member 12A, a length of a portion that is exposed outside is shortened. In addition, a slip preventing mechanism 29 is provided on the surface of the screw member 12A that is exposed outside. In such a housing container 1B as well, working effects similar to those of the above-described housing container according to the first embodiment for carrying out the present invention can be achieved. Furthermore, the skirt member 13A can be fitted in the palm of a hand, and the screw member 12A can be rotated by a finger. The housing container 1B can be easily operated with one hand.

In addition, as a result of the slip preventing mechanism 29 being provided, the screw member 12A can be easily rotated even with one hand.

That is, a drawing-out and open/close operation (one-click) can be performed by one hand. Usage can be further facilitated.

Here, according to the present embodiment, the slip preventing mechanism 29 is provided as that which has straight knurling. However, for example, the slip preventing mechanism 29 may be provided through application of a diamond-knurling pattern, decoration, engraving, or anti-slip coating. Such a slip preventing mechanism 29 can also be provided on the housing containers according to the first and second embodiments.

Figure 15:
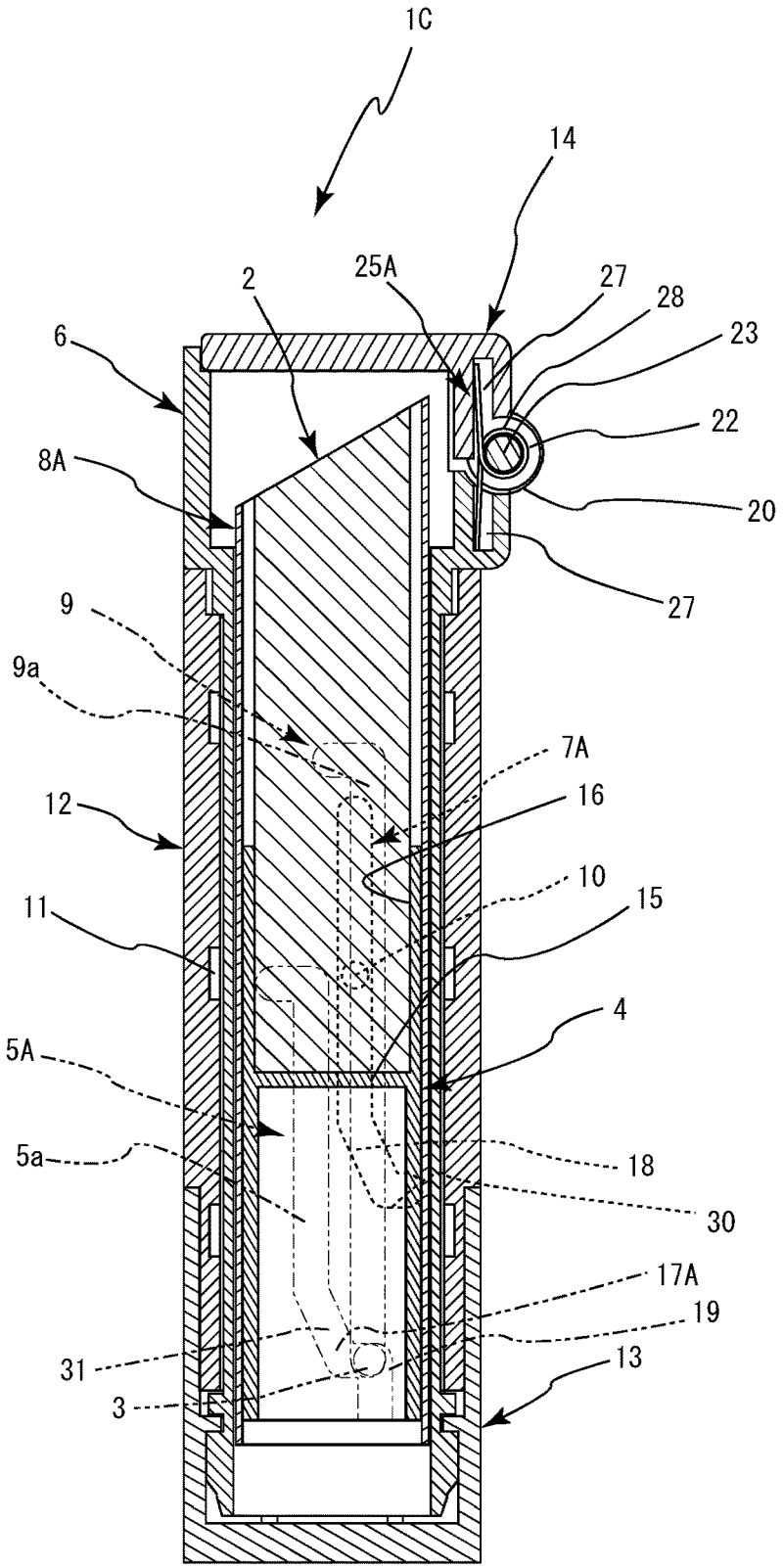
FIG. 15 to FIG. 20 are explanatory diagrams according to a fourth embodiment of the present invention.
Figure 16:
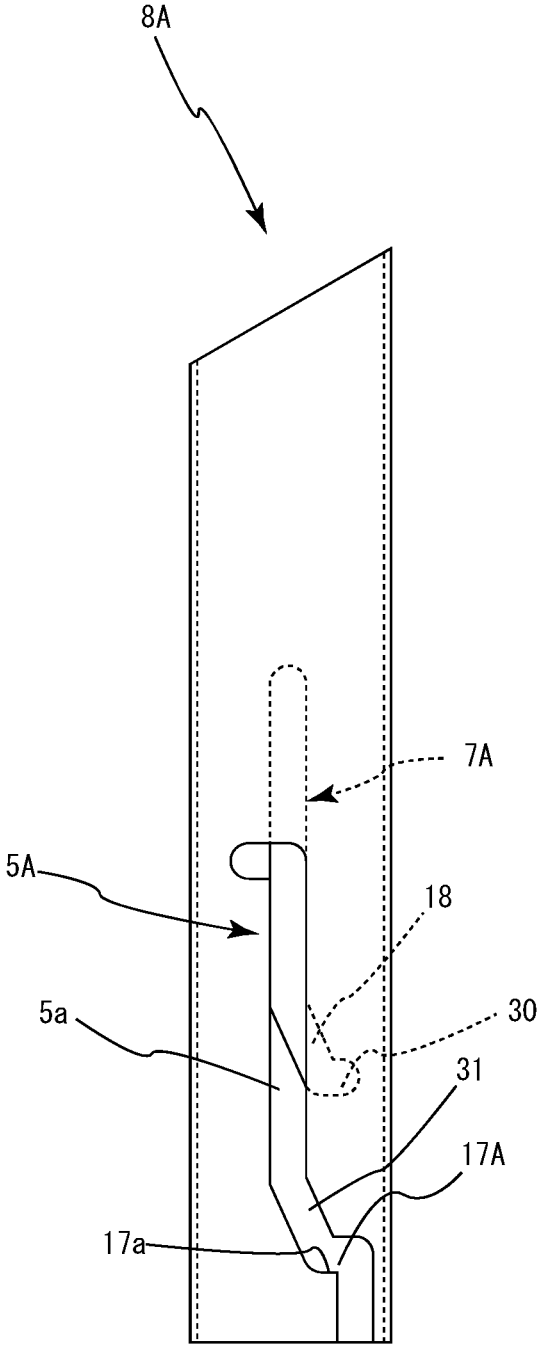
Figure 17:
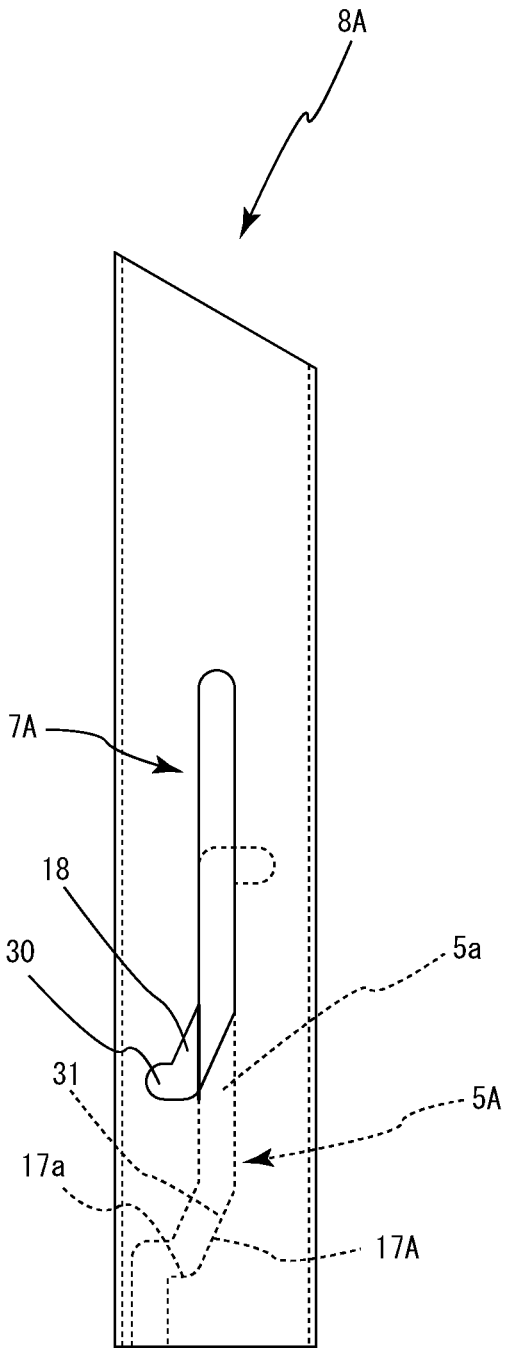
Figure 18:
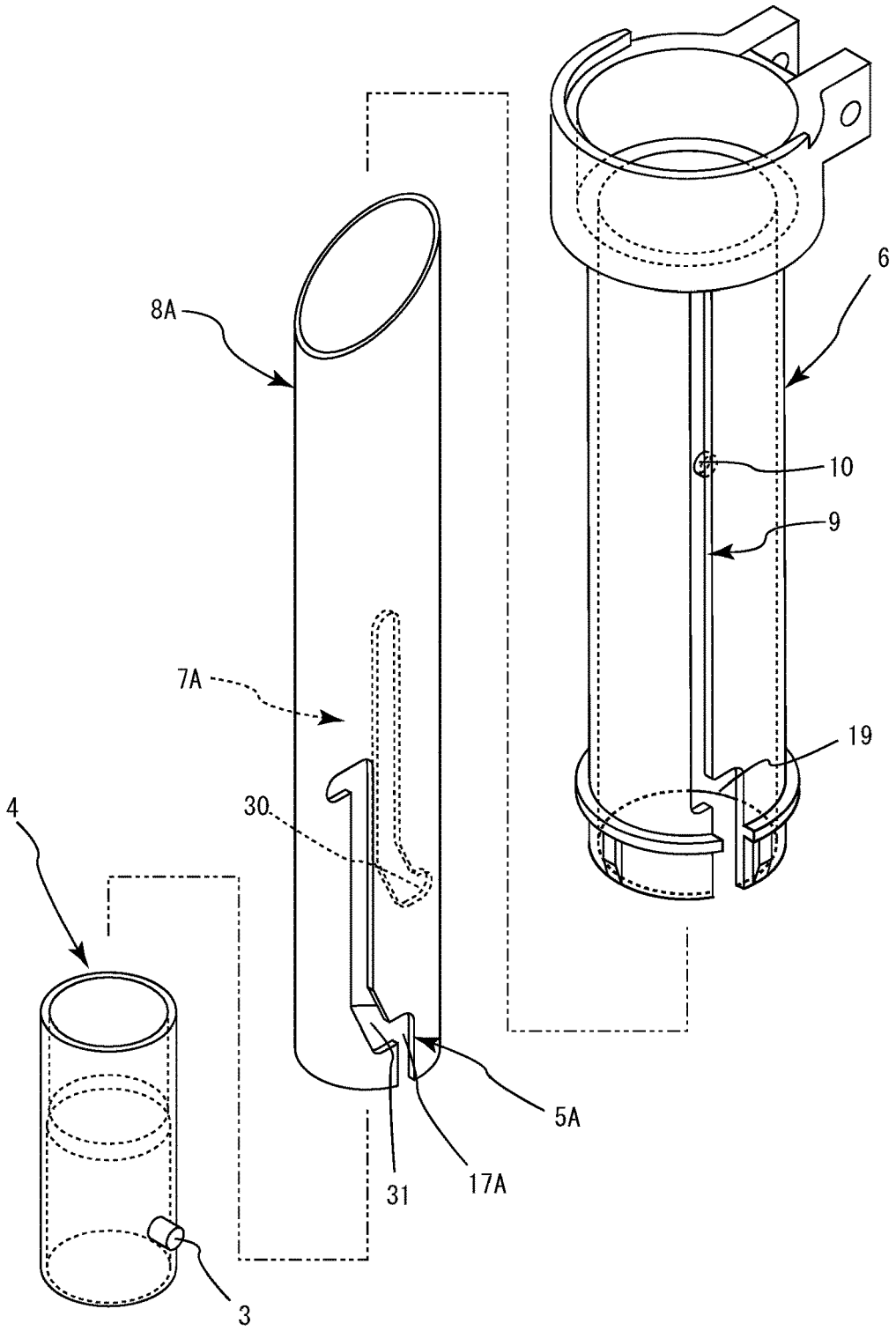
Figure 19:
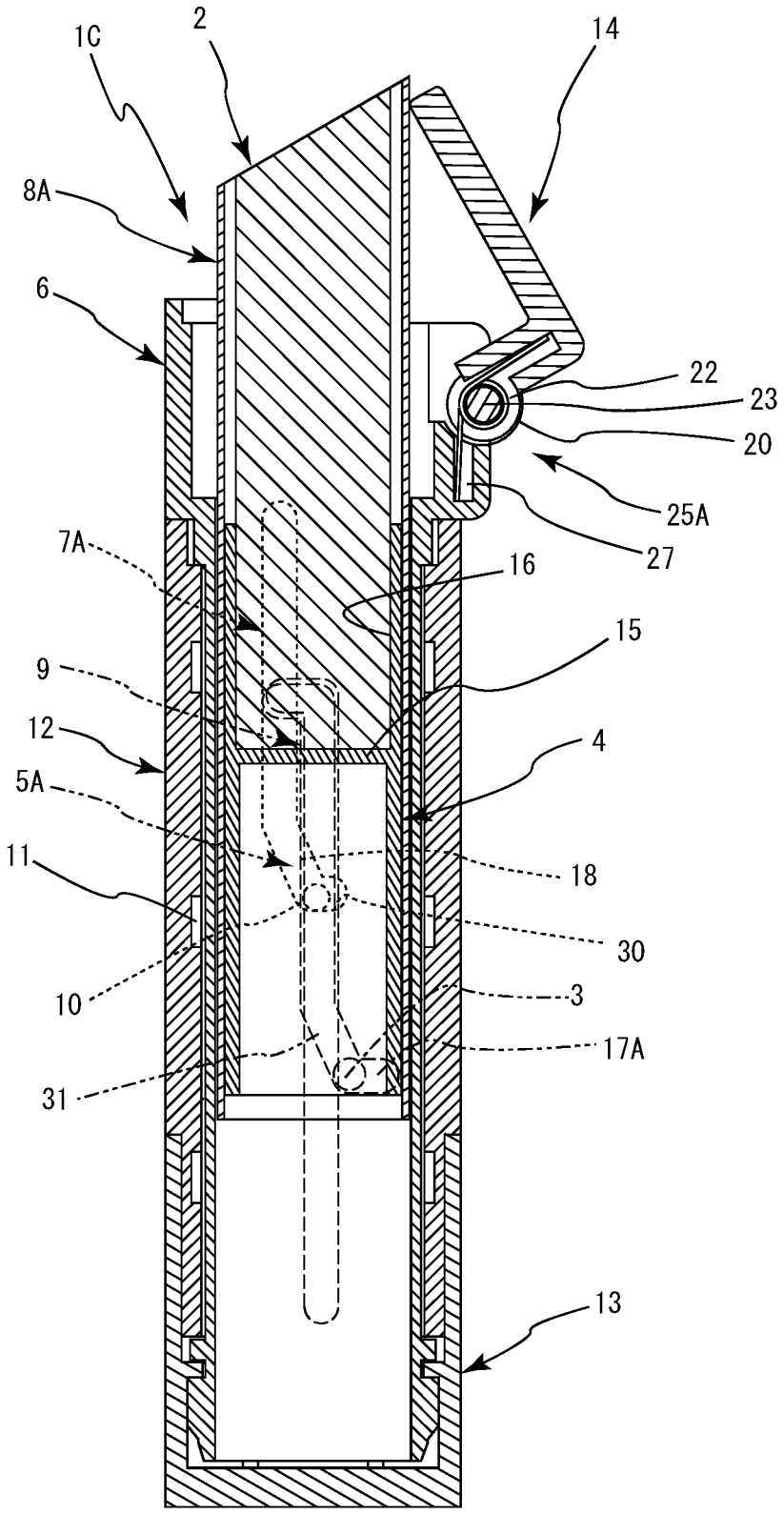
Figure 20:
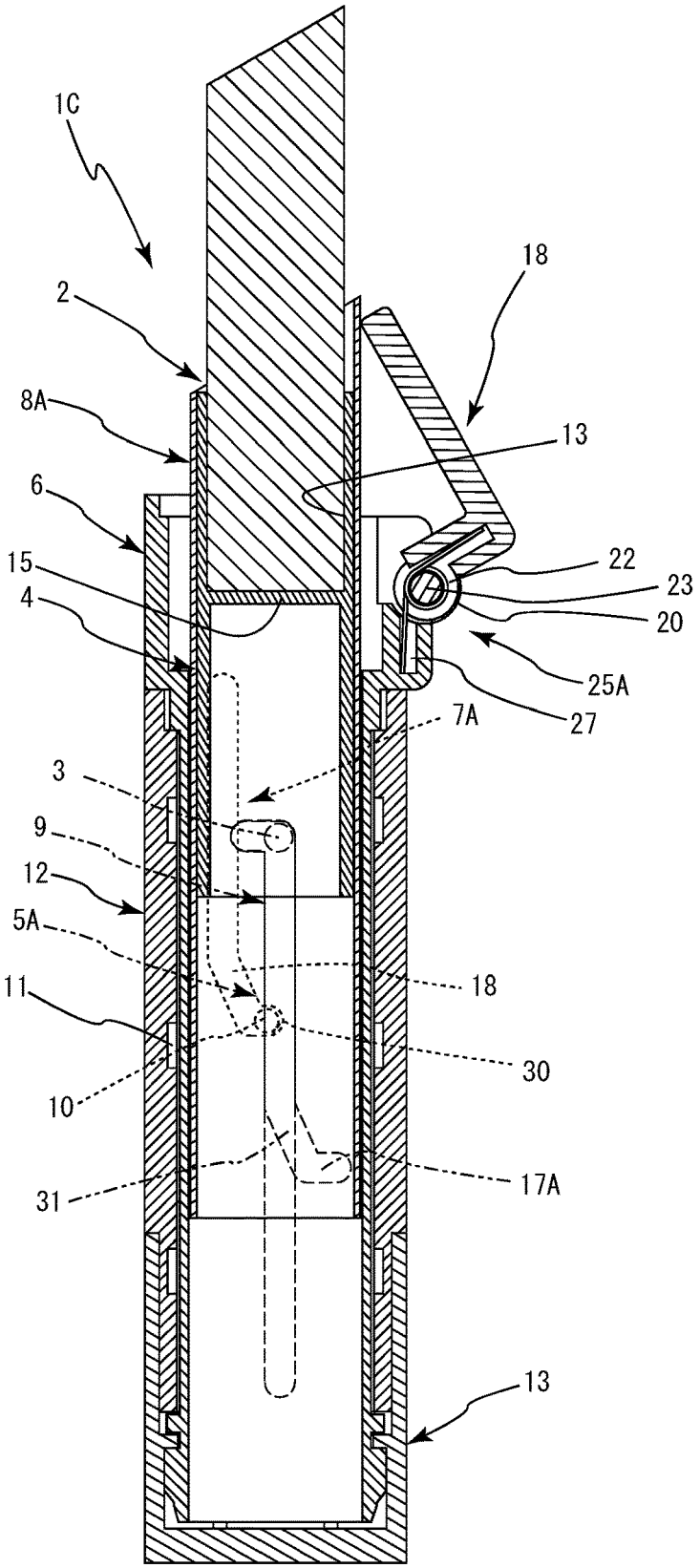

A fourth embodiment for carrying out the present invention, shown in FIG. 15 and FIG. 20, mainly differs from the first embodiment for carrying out the present invention in that a body-member slit groove 7A that has a locking portion 30 that further extends from the lower end portion of the sloped portion 18 in the circumferential direction is formed so as to be continuous with the sloped portion 18, and an inner cylinder member 8A in which a dish-member guide groove 5A is formed is provided. The dish-member guide groove 5A has a bent portion 17A in which a dish-member sloped portion 31 is formed so as to be continuous with the horizontal portion 17*a*. In such a housing container 1C as well, working effects similar to those of the above-described housing container according to the first embodiment for carrying out the present invention can be achieved.

Here, the guidance groove 9 according to the present embodiment is preferably formed such that the lower end portion reaches the lower end portions of the inner cylinder member 8A and the body member 6. As a result of the guidance groove 9 being formed in this manner, the engaging portion 3 can be easily inserted into the dish-member guide groove 5A and the guidance groove 9.

As a result of the locking portion 30 that substantially horizontally extends in the circumferential direction from the lower end portion of the sloped portion 18 of the body-member slit groove 7A being formed, when the dish member 4 is raised, the protrusion-shaped rotation control portion 10 enters the locking portion 30 as a result of the working of the dish-member sloped portion 31. Therefore, even when force from above is applied to the inner cylinder member 8A and the like in the state in which the rotation control portion 10 is inside the locking portion 30, the locking portion 30 can receive the load. The rotation control portion 10 can be prevented from entering the sloped portion 18.

Therefore, the inner cylinder member 8A rotating along the sloped portion 18, the rotation control portion 10 being sandwiched between the dish-member guide groove 5A and the guidance groove 9, and up/down movement of the rotation control portion 10 being obstructed can be prevented.

Here, according to the present embodiment, the urging means 25A similar to that according to the above-described second embodiment is used.

Movements of the dish member 4, the inner cylinder member 8A, the body member 6, and the like when the housing container 1C such as this is used will be described. When the engaging portion 3 is in the position of the lower dead point, the state is such that the engaging portion 3 of the dish member 4 is positioned in the horizontal portion 17*a* of the bent portion 17 of the dish-member guide groove 5A and the rotation control portion 10 is inserted into the body-member slit groove 7A. Therefore, the state is such that the inner cylinder member 8A does not rotate in relation to the body member 6, and the engaging portion 3 of the dish member 4 does not move from the horizontal portion 17*a*.

As a result of the screw member 12 being rotated, the engaging portion 3 of the dish member 4 is lifted along the screw groove 11 and the dish member 4 is raised. At this time, the engaging portion 3 of the dish member 4 is inserted into the guidance groove 9 of the body member 6. Therefore, the dish member 4 moves upward without rotating.

In addition, in the inner cylinder member 8A, the engaging portion 3 of the dish member 4 is in contact with the horizontal portion 17*a* of the bent portion 17. Therefore, the dish member 4 lifts the inner cylinder member 8A, and the dish member 4 and the inner cylinder member 8A are synchronously raised. The inner cylinder member 8A is simply merely lifted by the engaging portion 3. In addition, the rotation control portion 10 of the body member 6 is inserted into the body-member slit groove 7A. Therefore, the inner cylinder member 8A moves upward without rotating.

At this time, the inner cylinder member 8A lifts the cap body 14 and opens the upper end portion of the body member 6.

When the screw member 12 is continuously rotated and the rotation control portion 10 moves to the sloped portion 18 of the body-member slit groove 7A, the rotation control portion 10 moves into the sloped portion 18 of the inner cylinder member 8A. As a result, the inner cylinder member 8A slightly rotates and reaches the upper dead point of the inner cylinder member 8A.

Then, rising of the inner cylinder member 8A stops. In addition, the vertical portion 9*a* of the guidance groove 9 and the vertical portion 5*a* of the dish-member guide groove 5A substantially overlap. In accompaniment, the engaging portion 3 of the dish member 4 moves from the horizontal portion 17*a* of the bent portion 17 to the lower end portion (lower dead point) of the vertical portion 5*a* of the dish-member guide groove 5A.

As described above, when the inner cylinder member 8A and the dish member 4 synchronously move upward, as a result of being pressed by the upper end portion of the inner cylinder member 8A, the cap body 14 rotates against the urging force of the urging means 25A and enters an open state. In the state in which the inner cylinder member 8A is positioned at the upper dead point, the cap body 14 is in contact with the outer peripheral surface of the inner cylinder member 8A and maintains the open state without affecting the bar-shaped cosmetic 2.

As a result of the screw member 12 being rotated in this state, the inner cylinder member 8A remains at this position, and only the dish member 4 rises. As shown in FIG. 20, the bar-shaped cosmetic 2 is exposed.

When the dish member 4 rises to the vicinity of the upper dead point, the engaging portion 3 enters the dish-member sloped portion 31 that is formed in the dish-member guide groove 5A. In accompaniment, the dish member 4 and the inner cylinder member 8A slightly rotate in the circumferential direction. The inner cylinder member 8A cannot move upward any further as a result of the rotation control portion 10. Therefore, the inner cylinder member 8A rotates in the circumferential direction without moving upward.

Then, the rotation control portion 10 enters the locking portion 30 that extends in the circumferential direction from the lower end portion of the sloped portion 18. The rotation control portion 10 and the locking portion 30 are in an engaged state.

Meanwhile, the engaging portion 3 also enters the horizontal portion 17*a* of the bent portion 17A, and the dish portion 4 also reaches the upper dead point.

In this state, even when force from above is applied to the inner cylinder member 8A and the like, because the locking portion 30 and the rotation control portion 10 are in a state of contact in the up/down direction, the locking portion 30 can receive the load from above. The rotation control portion 10 entering the sloped portion 18 can be prevented.

Therefore, the inner cylinder member 8A rotating along the sloped portion 18, the rotation control portion 10 being sandwiched between the dish-member guide groove 5A and the guidance groove 9, and up/down movement of the rotation control portion 10 being obstructed can be prevented.

After use, when the bar-shaped cosmetic 2 is housed, the screw member 12 is rotated in the reverse direction and the dish member 4 is lowered. When the engaging portion 3 of the dish member 4 reaches the lower end portion (horizontal portion 17*a*) of the vertical portion 5*a* of the dish-member guide groove 5A, the inner cylinder member 8A is pressed downward by the engaging portion 3. The inner cylinder member 8A starts to move downward synchronously with the dish member 4. Then, the inner cylinder member 8A is rotated by the sloped portion 18 of the body-member slit groove 7A. Subsequently, the inner cylinder member 8A moves to a lower limit position without rotating and returns to the normal state.

The cap body 14 is rotated by the urging means 25A when the inner cylinder member 8A moves into the body member 6, and seals the upper portion opening of the body portion 6.

INDUSTRIAL APPLICABILITY

The bar-shaped cosmetic housing container of the present invention is used in industries in the field of manufacturing containers that house bar-shaped cosmetics that are solidified lip stick, lip cream, stick eyeshadow, stick foundation, concealer, sunscreen cosmetic, eye cream, hair product, and the like, and the field of cosmetic products.

What is claimed is:

1. A bar-shaped cosmetic housing container comprising:

a dish member that holds a bar-shaped cosmetic and has an engaging portion in a lower portion;

an inner cylinder member that has a dish-member guide groove with which the engaging portion of the dish member is engaged and a body-member slit groove with which a rotation control portion that is provided in a body member is engaged;

the body member that has a guidance groove with which the engaging portion is engaged and has the rotation control portion that is engaged with the body portion slit groove on an inner peripheral surface thereof;

a screw member in which a screw groove is formed on an inner peripheral surface, the engaging portion being engaged with the screw groove and the dish member being moved in an up/down direction; and a skirt member that is provided in a lower end portion of the body member, wherein the dish-member guide groove has a crank-shaped bent portion in a lower portion thereof and is formed to reach a lower end portion of the inner cylinder member, the body-member slit groove has a sloped portion that slopes in a circumferential direction in a lower portion thereof, and when the screw member is rotated and the dish member is raised, the engaging portion of the dish member comes into contact with the bent portion, and the inner cylinder member rises synchronously with the dish member and, when the rotation control portion moves to the sloped portion, the inner cylinder member is rotated in the circumferential direction by the sloped portion, the guidance groove and the dish-member guide groove are in a substantially overlapping state and, as a result, only the dish member rises.

2. The bar-shaped cosmetic housing container according to claim 1, wherein:

a cap body that freely opens and closes is provided in an upper end portion of the body member, and the cap body is urged in a direction in which a cap closes by an urging means.

3. The bar-shaped cosmetic housing container according to claim 2, wherein:

the urging means is configured by a pair of locking pieces that are formed in an upper portion of the body member and the cap body, and an annular elastic body that is locked by the pair of locking pieces.

4. The bar-shaped cosmetic housing container according to claim 1, wherein:

a slip preventing mechanism is provided on a surface of the screw member.

5. The bar-shaped cosmetic housing container according to claim 1, wherein:

a locking portion that further extends in the circumferential direction from a lower end portion of the sloped portion is formed in the body-member slit groove and, when the dish member is raised, the rotation control portion enters the locking portion.

* * * * *